US006932283B2

(12) United States Patent
Stier

(10) Patent No.: US 6,932,283 B2
(45) Date of Patent: Aug. 23, 2005

(54) FUEL INJECTION VALVE

(75) Inventor: Hubert Stier, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 110 days.

(21) Appl. No.: 10/258,299

(22) PCT Filed: Feb. 25, 2002

(86) PCT No.: PCT/DE02/00661

§ 371 (c)(1),
(2), (4) Date: Apr. 1, 2003

(87) PCT Pub. No.: WO02/068810

PCT Pub. Date: Sep. 6, 2002

(65) Prior Publication Data

US 2003/0160117 A1 Aug. 28, 2003

(30) Foreign Application Priority Data

Feb. 24, 2001 (DE) ..... 101 08 945

(51) Int. Cl.[7] ..... B05B 1/30; F02M 59/00; F02M 39/00

(52) U.S. Cl. ..... 239/585.1; 239/585.3; 239/585.4; 239/585.5; 239/533.2; 239/533.3

(58) Field of Search ..... 239/585.1–585.5, 239/533.2, 533.3, 533.9, 88–93; 251/129.15, 129.21, 127

(56) References Cited

U.S. PATENT DOCUMENTS 4,568,021 A 2/1986 Deckard et al.
4,909,439 A * 3/1990 Fu ..... 239/489
5,299,776 A 4/1994 Brinn et al.
5,421,521 A * 6/1995 Gibson et al. ..... 239/585.4
5,494,223 A * 2/1996 Hall et al. ..... 239/585.5
5,605,289 A * 2/1997 Maley et al. ..... 239/585.1
5,961,097 A 10/1999 Zimmermann
6,305,355 B1 10/2001 Hoffmann et al.

FOREIGN PATENT DOCUMENTS

DE 33 14 899 10/1984
DE 198 59 475 6/1999
DE 198 49 210 4/2000

* cited by examiner

*Primary Examiner*—Davis Hwu
(74) *Attorney, Agent, or Firm*—Kenyon & Kenyon

(57) ABSTRACT

A fuel injector, in particular for direct injection of fuel into the combustion chamber of a mixture-compressing, spark-ignited internal combustion engine, comprises an armature that coacts with a magnet coil, and comprises a valve needle, joined nonpositively to the armature, on which is provided a valve-closure member that, together with a valve-seat surface, forms a sealing seat. The valve needle has, at an inflow end, a collar-shaped armature stop, configured integrally with the valve needle, against which the armature comes to a stop, an engaging flange engaging through the armature in such a way that the engaging flange is insertable into the inflow end of the valve needle and is joinable thereto.

12 Claims, 1 Drawing Sheet

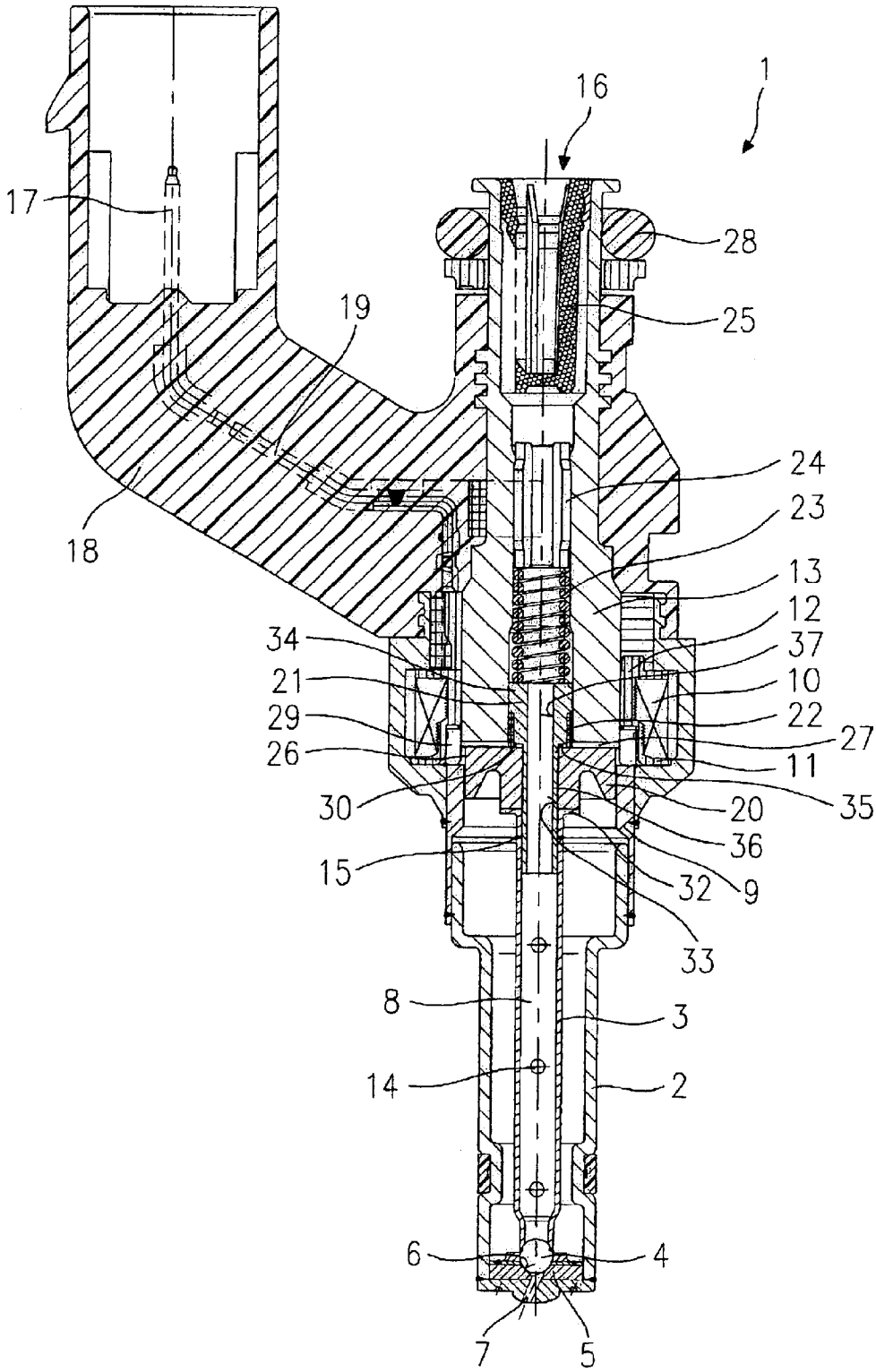
1
16
17
28
25
19
24
23
18
13
12
34
37
21
10
29
22
27
26
11
30
35
20
36
15
32
9
33
8
3
14
2
6
4
7
5

FUEL INJECTION VALVE

FIELD OF THE INVENTION

The present relates to a fuel injector according to the species defined in claim 1.

BACKGROUND INFORMATION

German Unexamined Patent Application No. 33 14 899 has already disclosed an electromagnetically actuable fuel injector in which, for electromagnetic actuation, an armature coacts with an electrically energizable magnet coil, and the linear stroke of the armature is transferred via a valve needle to a valve-closure member. The valve-closure member coacts with a valve seat. The armature is not rigidly mounted on the valve needle, but rather is positioned axially movably with respect to the valve needle. A first return spring impinges upon the valve needle in the closing direction and thus holds the fuel injector closed when the magnet coil is in the zero-current, unenergized state. The armature is impinged upon by a second return spring in the linear stroke direction in such a way that in the inactive position, the armature rests against a first stop provided on the valve needle. Upon energization of the magnet coil, the armature is pulled in the linear stroke direction and entrains the valve needle by way of the first stop. Upon shutoff of the current energizing the magnet coil, the valve needle is accelerated by the first return spring into its closed position, and carries the armature along by way of the stop described above. As soon as the valve-closure member encounters the valve seat, the closing motion of the valve needle is abruptly terminated. The motion of the armature, which is not rigidly joined to the valve needle, continues opposite to the linear stroke direction and is absorbed by the second return spring, i.e. the armature oscillates through against the second return spring, which has a much lower spring constant compared to the first return spring. Lastly, the second return spring accelerates the armature again in the linear stroke direction. Similar fuel injectors are known from German Published Patent Application No. 198 49 210 and U.S. Pat. No. 5,299,776.

The fuel injector known from German Unexamined Patent Application No. 33 14 899 is disadvantageous in particular because of the complex configuration, which provides several individual components for the upper and the lower armature stop. As a result, the manufacturing tolerances of the individual components add up to an overall tolerance which has a disadvantageous effect on the switching precision of the fuel injector.

SUMMARY OF THE INVENTION

The fuel injector according to the present invention has, in contrast, the advantage that one of the armature stops, which defines the magnitude of a pre-stroke gap for a freely movable armature design, is configured integrally with the valve needle, with the result that inaccuracies due to manufacturing tolerances have less of an effect due to the elimination of at least one component. The armature stop positioned at the outflow side of the armature is configured integrally with the valve needle, and forms a collar against which the armature makes contact.

It is additionally advantageous that an engaging flange which brings about the nonpositive engagement between the armature and the valve needle passes through the armature and is insertable into the valve needle.

It is additionally advantageous that the magnitude of the pre-stroke gap is adjustable by displacement of the engaging flange in the valve needle.

Advantageously, a pre-stroke spring impinges upon the armature when the fuel injector is in the inactive state, so that it is held in contact against the outflow-side armature stop.

Because of the hollow-cylindrical configuration of the engaging flange, the fuel flowing through the fuel injector can be directed, without diversions, directly through the valve needle to the flowthrough openings and the sealing seat.

The provision of a guidance region on the engaging flange, which ensures exact guidance of the valve needle during its axial motion, is additionally advantageous.

BRIEF DESCRIPTION OF THE DRAWING

The FIGURE is a schematic section through an exemplified embodiment of a fuel injector configured in accordance with the present invention.

DETAILED DESCRIPTION

A fuel injector 1 is embodied in the form of a fuel injector for fuel injection systems of mixture-compressing, spark-ignited internal combustion engines. Fuel injector 1 is suitable in particular for direct injection of fuel into a combustion chamber (not depicted) of an internal combustion engine.

Fuel injector 1 is made up of a nozzle body 2 in which a valve needle 3 is positioned. Valve needle 3 is in working engagement with a valve-closure member 4 which coacts with a valve-seat surface 6, positioned on a valve-seat member 5, to form a sealing scat. In the exemplified embodiment, fuel injector 1 is an inwardly-opening fuel injector 1 that possesses one spray discharge opening 7. Nozzle body 2 is joined, preferably by welding, to an external pole 9 of a magnet coil 10. Magnet coil 10 is encapsulated in a coil housing 11 and wound onto a coil support 12 that rests on an internal pole 13 of magnet coil 10. Internal pole 13 and external pole 9 are separated from one another by a gap 26, and are braced against a connecting component 29. Magnet coil 10 is energized, via a conductor 19, by an electrical current that can be conveyed via an electrical plug contact 17. Plug contact 17 is surrounded by a plastic sheath 18 that can be injection-molded onto internal pole 13.

In the present exemplified embodiment, valve needle 3 is of thin-walled hollow-cylindrical configuration and has a central recess 8. Flowthrough openings 14 present in the wall of valve needle 3 serve to direct fuel to the sealing seat. Valve needle 3 has at its inflow end a collar-shaped armature stop 32 that is configured integrally with valve needle 3. Braced against armature stop 32 is an armature 20. The latter is joined nonpositively to valve needle 3 via an engaging flange 21. Engaging flange 21 is also of tubular configuration, and passes through armature 20 through a central recess 33. Engaging flange 21 is slid into the inflow end of valve needle 3 and joined to valve needle 3 with a weld seam 15. Braced against engaging flange 21 is a return spring 23 which, in the present configuration of fuel injector 1, is preloaded by a sleeve 24. Return spring 23 impinges upon valve needle 3, via engaging flange 21, in such a way that valve-closure member 4 is held in sealing contact against valve-seat surface 6.

Engaging flange 21 has an outer enveloping surface that, upon actuation of fuel injector 1, supports valve needle 3 during its axial motion as a guide region, in such a way that misalignments and subsequent malfunctions of fuel injector 1 due to a tilted or jammed valve needle 3 can be prevented. Downstream from projection 34, engaging flange 21 possesses a guidance segment 36 that serves to guide armature 20.

A pre-stroke spring 22, which impinges upon armature 20 in such a way that it is held in contact against armature stop 32, is positioned between armature 20 and a projection 34 of engaging flange 21.

Fuel delivered through a central fuel inlet 16 and filtered through a filter element 25 is directed through recess 8 of valve needle 3, a passthrough opening 37 in engaging flange 21, and via flow openings 14 to spray discharge opening 7. Fuel injector 1 is scaled by a seal 28 with respect to a distribution line (not depicted in further detail).

When fuel injector 1 is in the inactive state, engaging flange 21 inserted into valve needle 3 is impinged upon by return spring 23 opposite to its linear stroke direction in such a way that valve-closure member 4 is held in sealing contact against valve seat 6. Armature 20, impinged upon by pre-stroke spring 22, rests against armature stop 32. Upon energization of magnet coil 10, the latter establishes a magnetic field that moves armature 20 in the linear stroke direction against the spring force of pre-stroke spring 22 and return spring 23. The linear stroke of armature 20 is divided into a pre-stroke that serves to close a pre-stroke gap 30, and an opening stroke. The opening stroke and pre-stroke together result in the overall linear stroke, which is defined by a working gap 27 present, in the inactive position, between internal pole 12 and armature 20. The axial height of pre-stroke gap 30 is defined by a shoulder 35 of engaging flange 21 facing toward armature 20; armature 20 engages under said shoulder after the closure of pre-stroke gap 30, thereby achieving the nonpositive engagement for actuation of valve needle 3.

Once the pre-stroke has been taken up against the force of pre-stroke spring 22, armature 20 entrains engaging flange 21 which is welded to valve needle 3, and thus valve needle 3, in the linear stroke direction. Valve-closure member 4 that is in working engagement with valve needle 3 lifts off from valve-seat surface 6, so that the fuel, guided via recess 8 in valve needle 3 and through flowthrough openings 14 to spray discharge opening 7, is discharged.

When the coil current is shut off and once the magnetic field has decayed sufficiently, armature 20 falls onto engaging flange 21 from internal pole 13 as a result of the pressure of return spring 23, thereby moving valve needle 3 opposite to the linear stroke direction. Valve-closure member 4 thus settles onto valve-seat surface 6, and fuel injector 1 is closed. Armature 20 settles onto armature stop 32.

In addition to improving the opening dynamics, pre-stroke spring 22 brings about a damping effect against bouncing of armature 20 on armature stop 32 upon closure of fuel injector 1. The reason is that as armature 20 settles onto armature stop 32, armature 20 can briefly lift off from armature stop 32 again. Pre-stroke spring 22 decelerates the motion of armature 20 in the linear stroke direction that occurs in this context, so that engaging flange 21 and thus also valve needle 3 remain unaffected by the motion of armature 20, and no undesired short-term opening events of fuel injector 1 occur.

Because armature stop 32 is configured integrally with valve needle 3, at least one of the components can be eliminated as compared to the existing art, so that manufacturing tolerances have less of an effect.

The invention is not limited to the exemplified embodiment presented and is also applicable to other forms of armature 20, for example to plunger and flat armatures, and to fuel injectors 1 of any design.

What is claimed is:

1. A fuel injector, comprising:

a magnet coil;

a valve needle;

an armature that coacts with the magnet coil and to which is joined nonpositively the valve needle;

a valve-seat surface;

a valve-closure member provided on the valve needle, the valve-closure member together with the valve-seat surface forming a sealing seat; and an engaging flange reaching through the armature in such a way that the engaging flange is insertable into an inflow end of the valve needle and is joinable thereto, wherein:

the valve needle includes, at the inflow end, a collar-shaped armature stop that is configured integrally with the valve needle and against which the armature comes to a stop.

2. The fuel injector as recited in claim 1, wherein:

the fuel injector is for a direct injection of a fuel into a combustion chamber of a mixture-compressing, spark-ignited internal combustion engine.

3. The fuel injector as recited in claim 1, further comprising:

a return spring, wherein:

the engaging flange includes a projection against which the return spring is braced on an inflow side.

4. The fuel injector as recited in claim 3, further comprising:

a pre-stroke spring positioned between the armature and the projection of the engaging flange.

5. The fuel injector as recited in claim 3, wherein:

the engaging flange includes, downstream from the projection, a guidance segment on which the armature is guided during an axial motion.

6. The fuel injector as recited in claim 3, wherein:

an outer enveloping surface of the engaging flange in a region of the projection serves as a guide for the valve needle, the valve needle being movable in an axial direction.

7. The fuel injector as recited in claim 1, wherein:

the engaging flange is joined to the valve needle by way of a weld seam.

8. The fuel injector as recited in claim 1, wherein:

the engaging flange includes a shoulder facing toward the armature.

9. The fuel injector as recited in claim 8, wherein:

an axial spacing between the armature and the shoulder defines a pre-stroke gap.

10. The fuel injector as recited in claim 1, wherein:

the valve needle is shaped by a deep drawing operation.

11. The fuel injector as recited in claim 1, wherein:

the engaging flange includes a tubular configuration and includes an internal passthrough opening for a fuel flow.

12. The fuel injector as recited in claim 1, wherein:

the armature is mounted on the engaging flange so as to be axially movable.

* * * * *

UNITED STATES PATENT AND TRADEMARK OFFICE

CERTIFICATE OF CORRECTION

PATENT NO. : 6,932,283 B2
DATED : August 23, 2005
INVENTOR(S) : Hubert Stier

It is certified that error appears in the above-identified patent and that said Letters Patent is hereby corrected as shown below:

Title page,
Item [57], ABSTRACT,
Line 6, change "a valve-scat" to -- a valve-seat --.
Line 7, change "a sealing scat" to -- a sealing seat --.

Signed and Sealed this

Fifteenth Day of November, 2005

JON W. DUDAS
*Director of the United States Patent and Trademark Office*